US010068531B2

(12) United States Patent
Hyun et al.

(10) Patent No.: US 10,068,531 B2
(45) Date of Patent: Sep. 4, 2018

(54) PIXEL CIRCUIT AND ORGANIC LIGHT EMITTING DISPLAY DEVICE INCLUDING THE SAME

(71) Applicant: Samsung Display Co., Ltd., Yongin-Si, Gyeonggi-Do (KR)

(72) Inventors: Chang-Ho Hyun, Seoul (KR); Cheol-Woo Park, Suwon-si (KR)

(73) Assignee: SAMSUNG DISPLAY CO., LTD., Gyeonggi-Do (KR)

( * ) Notice: Subject to any disclaimer, the term of this patent is extended or adjusted under 35 U.S.C. 154(b) by 0 days.

(21) Appl. No.: 15/161,655

(22) Filed: May 23, 2016

(65) Prior Publication Data

US 2017/0098415 A1 Apr. 6, 2017

(30) Foreign Application Priority Data

Oct. 2, 2015 (KR) ..... 10-2015-0138872

(51) Int. Cl.
*G09G 3/3291* (2016.01)
*G09G 3/3266* (2016.01)

(52) U.S. Cl.
CPC ..... *G09G 3/3291* (2013.01); *G09G 3/3266* (2013.01); *G09G 2300/0842* (2013.01); *G09G 2300/0871* (2013.01); *G09G 2310/0278* (2013.01); *G09G 2310/0289* (2013.01); *G09G 2330/021* (2013.01); *G09G 2330/028* (2013.01)

(58) Field of Classification Search
CPC ..... G09G 3/3291; G09G 2310/0278; G09G 2330/028; G09G 3/3283
See application file for complete search history.

(56) References Cited

U.S. PATENT DOCUMENTS

2004/0263503 A1* 12/2004 Seki ..... G09G 3/3233 345/204
2011/0285691 A1* 11/2011 Takasugi ..... G09G 3/3233 345/212
2012/0120046 A1* 5/2012 Senda ..... G09G 3/3225 345/211
2016/0253960 A1* 9/2016 Xie ..... G09G 3/3225 345/690

FOREIGN PATENT DOCUMENTS

KR 1020080052101 A 6/2008

* cited by examiner

*Primary Examiner* — Dennis Joseph
(74) *Attorney, Agent, or Firm* — Cantor Colburn LLP

(57) ABSTRACT

A pixel circuit includes an organic light emitting diode including an anode and a cathode connected to a low power voltage, a first transistor including a gate electrode, a first electrode connected to a high power voltage, and a second electrode connected to the anode, a storage capacitor connected between the high power voltage and the gate electrode of the first transistor, a second transistor including a first electrode which receives a data signal corresponding to an emission sustaining voltage or an emission finishing voltage, a second electrode connected to the gate electrode of the first transistor, and a gate electrode which receives an erase scan signal, and a third transistor including a first electrode connected to an emission starting voltage, a second electrode connected to the gate electrode of the first transistor, and a gate electrode which receives a write scan signal.

10 Claims, 7 Drawing Sheets

PIXEL CIRCUIT AND ORGANIC LIGHT EMITTING DISPLAY DEVICE INCLUDING THE SAME

This application claims priority to Korean Patent Application No. 10-2015-0138872, filed on Oct. 2, 2015, and all the benefits accruing therefrom under 35 U.S.C. § 119, the content of which in its entirety is herein incorporated by reference.

BACKGROUND

1. Field

Exemplary embodiments relate generally to a display device. More particularly, embodiments of the inventive concept relate to a pixel circuit having an organic light emitting diode and an organic light emitting display device including the pixel circuit.

2. Description of the Related Art

Recently, an organic light emitting display device is typically driven by an analog driving technique that implements (i.e., displays) a specific gray-scale based on a voltage stored in a storage capacitor of each pixel circuit or by a digital driving technique that divides one frame into a plurality of sub-frames and implements a specific gray-scale based on a sum of emission times of the sub-frames. Generally, the digital driving technique controls a driving transistor of each pixel circuit to operate in a non-saturation region. Thus, when the organic light emitting display device is driven by the digital driving technique, an internal compensation circuit for compensating threshold voltage deviation may not be used because an operational change due to the threshold voltage deviation is relatively low, and power consumption of the organic light emitting display device is relatively low because a driving voltage applied to the driving transistor is relatively low.

SUMMARY

The digital driving technique controls a maximum current to flow through the organic light emitting diode in the emission times of the sub-frames, such that a lifetime of the organic light emitting diode is relatively short. In the digital driving technique, since a specific gray-scale is implemented by a sum of the emission times of the sub-frames, a dynamic false contour may occur.

Some exemplary embodiments provide a pixel circuit that may implement a specific gray-scale by adjusting an emission time of an organic light emitting diode of the pixel circuit while controlling a driving transistor of the pixel circuit to operate in a saturation region.

Some exemplary embodiments provide an organic light emitting display device including the pixel circuit that may display or output a high-quality image.

According to some exemplary embodiments, a pixel circuit may include an organic light emitting diode including an anode and a cathode connected to a low power voltage, a first transistor including a gate electrode, a first electrode connected to a high power voltage, and a second electrode connected to the anode of the organic light emitting diode, a storage capacitor connected between the high power voltage and the gate electrode of the first transistor, a second transistor including a first electrode which receives a data signal corresponding to an emission sustaining voltage or an emission finishing voltage, a second electrode connected to the gate electrode of the first transistor, and a gate electrode which receives an erase scan signal, and a third transistor including a first electrode connected to an emission starting voltage, a second electrode connected to the gate electrode of the first transistor, and a gate electrode which receives a write scan signal. In such an embodiment, an emission of the organic light emitting diode may be started when the first transistor is turned on in response to the emission starting voltage applied to the gate electrode of the first transistor through the third transistor, and the emission of the organic light emitting diode may be sustained when the first transistor is turned on in response to the emission sustaining voltage applied to the gate electrode of the first transistor through the second transistor, and the emission of the organic light emitting diode may be finished when the first transistor is turned off in response to the emission finishing voltage applied to the gate electrode of the first transistor through the second transistor.

In an exemplary embodiment, the first transistor may operate in a saturation region.

In an exemplary embodiment, each of the first through third transistors may be a p-type metal oxide semiconductor ("PMOS") transistor. In such an embodiment, the emission starting voltage may have a low voltage level, the emission sustaining voltage may have a low voltage level, and the emission finishing voltage may have a high voltage level.

In an exemplary embodiment, the emission starting voltage may be the low power voltage.

In an exemplary embodiment, the emission starting voltage may be applied to the gate electrode of the first transistor when each frame starts. In such an embodiment, the emission finishing voltage may be applied to the gate electrode of the first transistor when a predetermined emission time of the organic light emitting diode elapses after the emission starting voltage is applied to the gate electrode of the first transistor. In such an embodiment, the emission sustaining voltage may be applied to the gate electrode of the first transistor before the predetermined emission time of the organic light emitting diode elapses after the emission starting voltage is applied to the gate electrode of the first transistor.

In an exemplary embodiment, the predetermined emission time of the organic light emitting diode may be determined to be a sum of consecutive sub-emission times which are set based on a binary coding or a Fibonacci sequence.

According to another exemplary embodiment, a pixel circuit may include an organic light emitting diode including an anode and a cathode connected to a low power voltage, a first transistor including a gate electrode, a first electrode connected to a high power voltage, and a second electrode connected to the anode of the organic light emitting diode, a storage capacitor connected between the high power voltage and the gate electrode of the first transistor, and a second transistor including a first electrode which receives a data signal corresponding to an emission sustaining voltage or an emission finishing voltage, a second electrode connected to the gate electrode of the first transistor, and a gate electrode which receives an erase scan signal. In such an embodiment, an emission of the organic light emitting diode may be started when the first transistor is turned on in response to the emission starting voltage applied to the gate electrode of the first transistor from an external component, and the emission of the organic light emitting diode may be sustained when the first transistor is turned on in response to the emission sustaining voltage applied to the gate electrode of the first transistor through the second transistor, and the emission of the organic light emitting diode may be finished when the first transistor is turned off in response to the emission finishing voltage applied to the gate electrode of the first transistor through the second transistor.

In an exemplary embodiment, the first transistor may operate in a saturation region.

In an exemplary embodiment, each of the first and second transistors may be a PMOS transistor. In such an embodiment, the emission starting voltage may have a low voltage level, the emission sustaining voltage may have a low voltage level, and the emission finishing voltage may have a high voltage level.

In an exemplary embodiment, the emission starting voltage may be the low power voltage.

In an exemplary embodiment, the emission starting voltage may be applied to the gate electrode of the first transistor when each frame starts. In such an embodiment, the emission finishing voltage may be applied to the gate electrode of the first transistor when a predetermined emission time of the organic light emitting diode elapses after the emission starting voltage is applied to the gate electrode of the first transistor, and the emission sustaining voltage may be applied to the gate electrode of the first transistor before the predetermined emission time of the organic light emitting diode elapses after the emission starting voltage is applied to the gate electrode of the first transistor.

In an exemplary embodiment, the predetermined emission time of the organic light emitting diode may be determined to be a sum of consecutive sub-emission times which are set based on a binary coding or a Fibonacci sequence.

According to another exemplary embodiment, an organic light emitting display device may include a display panel having a plurality of pixel circuits, a data driver which provides a data signal to the display panel, a write scan driver which provides a write scan signal to the display panel, an erase scan driver which provides an erase scan signal to the display panel, a timing controller which controls the data driver, the write scan driver, and the erase scan driver, and a power supply which provides a high power voltage and a low power voltage to the display panel. In such an embodiment, each of the pixel circuits may start an emission of an organic light emitting diode based on the write scan signal and may sustain the emission of the organic light emitting diode for a predetermined emission time of the organic light emitting diode based on the erase scan signal and the data signal.

In an exemplary embodiment, the timing controller may receive image data from an external source, may perform an optical compensating operation on the image data to generate compensated image data, and may provide the compensated image data to the data driver.

In an exemplary embodiment, the write scan driver may provide the write scan signal to the display panel by a unit of pixel-row of the display panel.

In an exemplary embodiment, each of the pixel circuits may include the organic light emitting diode including an anode and a cathode connected to the low power voltage, a first transistor including a gate electrode, a first electrode connected to the high power voltage, and a second electrode connected to the anode of the organic light emitting diode, a storage capacitor connected between the high power voltage and the gate electrode of the first transistor, a second transistor including a first electrode which receives the data signal corresponding to an emission sustaining voltage or an emission finishing voltage, a second electrode connected to the gate electrode of the first transistor, and a gate electrode which receives the erase scan signal, and a third transistor including a first electrode connected to an emission starting voltage corresponding to the low power voltage, a second electrode connected to the gate electrode of the first transistor, and a gate electrode that receives the write scan signal. In such an embodiment, the emission of the organic light emitting diode may be started when the first transistor is turned on in response to the emission starting voltage applied to the gate electrode of the first transistor through the third transistor, and the emission of the organic light emitting diode may be sustained when the first transistor is turned on in response to the emission sustaining voltage applied to the gate electrode of the first transistor through the second transistor, and the emission of the organic light emitting diode may be finished when the first transistor is turned off in response to the emission finishing voltage applied to the gate electrode of the first transistor through the second transistor.

In an exemplary embodiment, the emission starting voltage may be applied to the gate electrode of the first transistor when each frame starts. In such an embodiment, the emission finishing voltage may be applied to the gate electrode of the first transistor when the predetermined emission time of the organic light emitting diode elapses after the emission starting voltage is applied to the gate electrode of the first transistor. In such an embodiment, the emission sustaining voltage may be applied to the gate electrode of the first transistor before the predetermined emission time of the organic light emitting diode elapses after the emission starting voltage is applied to the gate electrode of the first transistor.

In an exemplary embodiment, the write scan driver may provide the write scan signal to the display panel by a unit of pixel-block of the display panel, where each pixel-block of the display panel includes a plurality of pixel-rows of the display panel.

In an exemplary embodiment, each of the pixel circuits may include the organic light emitting diode including an anode and a cathode connected to the low power voltage, a first transistor including a gate electrode, a first electrode connected to the high power voltage, and a second electrode connected to the anode of the organic light emitting diode, a storage capacitor connected between the high power voltage and the gate electrode of the first transistor, and a second transistor including a first electrode which receives the data signal corresponding to an emission sustaining voltage or an emission finishing voltage, a second electrode connected to the gate electrode of the first transistor, and a gate electrode which receives the erase scan signal. In such an embodiment, the emission of the organic light emitting diode may be started when the first transistor is turned on in response to the emission starting voltage applied to the gate electrode of the first transistor from an external component, and the emission of the organic light emitting diode may be sustained when the first transistor is turned on in response to the emission sustaining voltage applied to the gate electrode of the first transistor through the second transistor, and the emission of the organic light emitting diode may be finished when the first transistor is turned off in response to the emission finishing voltage applied to the gate electrode of the first transistor through the second transistor.

In an exemplary embodiment, the emission starting voltage may be applied to the gate electrode of the first transistor when each frame starts. In such an embodiment, the emission finishing voltage may be applied to the gate electrode of the first transistor when the predetermined emission time of the organic light emitting diode elapses after the emission starting voltage is applied to the gate electrode of the first transistor. In such an embodiment, the emission sustaining voltage may be applied to the gate electrode of the first transistor before the predetermined emission time of the organic light emitting diode elapses after the emission starting voltage is applied to the gate electrode of the first transistor.

In such embodiments, a pixel circuit may start (or begin) an emission of an organic light emitting diode of the pixel circuit by turning on a driving transistor of the pixel circuit based on a write scan signal when each frame starts and may sustain (or keep) the emission of the organic light emitting diode for a predetermined or desired emission time of the organic light emitting diode based on an erase scan signal and a data signal (e.g., may finish (or end) the emission of the organic light emitting diode when the predetermined or desired emission time of the organic light emitting diode elapses). Thus, the pixel circuit may implement a specific gray-scale by adjusting an emission time of the organic light emitting diode while controlling the driving transistor to operate in a saturation region.

In such embodiments, an organic light emitting display device including the pixel circuit according to exemplary embodiments may display a high-quality image.

BRIEF DESCRIPTION OF THE DRAWINGS

Illustrative, non-limiting exemplary embodiments will be more clearly understood from the following detailed description taken in conjunction with the accompanying drawings.

DETAILED DESCRIPTION

Figure 1:
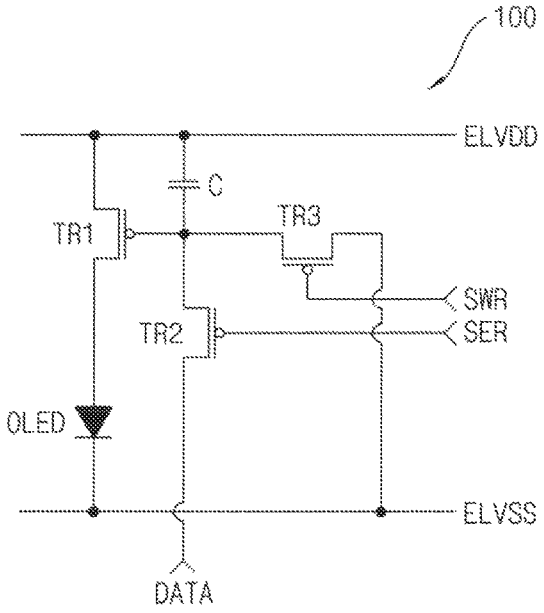
FIG. 1 is a circuit diagram illustrating an exemplary embodiment of a pixel circuit according to the invention.

The invention now will be described more fully hereinafter with reference to the accompanying drawings, in which various embodiments are shown. This invention may, however, be embodied in many different forms, and should not be construed as limited to the embodiments set forth herein. Rather, these embodiments are provided so that this disclosure will be thorough and complete, and will fully convey the scope of the invention to those skilled in the art. Like reference numerals refer to like elements throughout.

It will be understood that, although the terms "first," "second," "third" etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, "a first element," "component," "region," "layer" or "section" discussed below could be termed a second element, component, region, layer or section without departing from the teachings herein The terminology used herein is for the purpose of describing particular embodiments only and is not intended to be limiting. As used herein, the singular forms "a," "an," and "the" are intended to include the plural forms, including "at least one," unless the content clearly indicates otherwise. "Or" means "and/or." As used herein, the term "and/or" includes any and all combinations of one or more of the associated listed items. It will be further understood that the terms "comprises" and/or "comprising," or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

Unless otherwise defined, all terms (including technical and scientific terms) used herein have the same meaning as commonly understood by one of ordinary skill in the art to which this disclosure belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

Hereinafter, the invention will be explained in detail with reference to the accompanying drawings.

Figure 2:
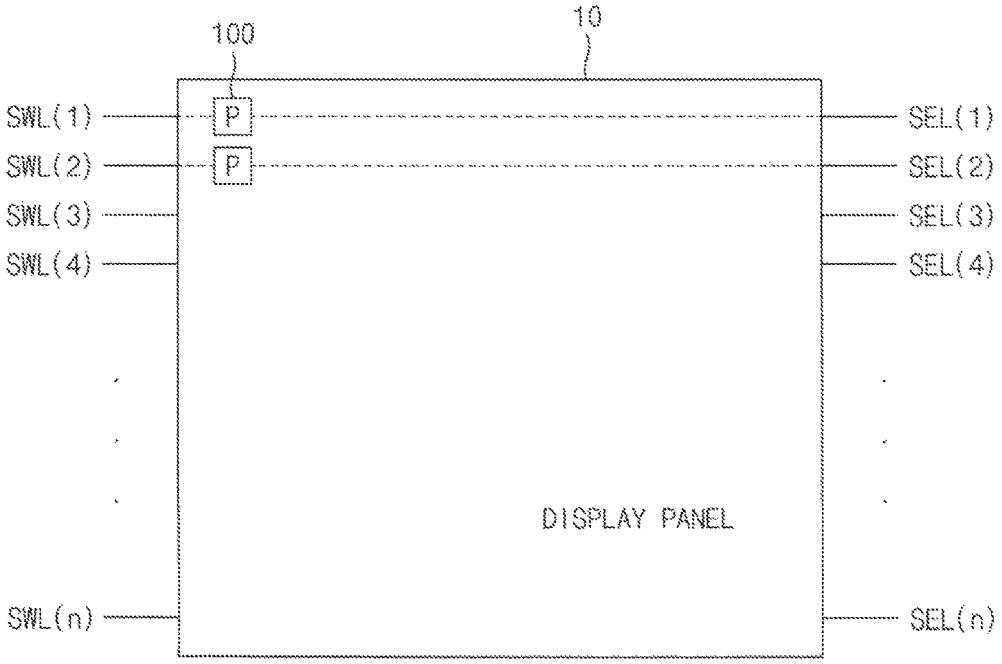
FIG. 2 is a diagram for describing that a write scan signal and an erase scan signal are received by the pixel circuit of FIG. 1.

FIG. 1 is a circuit diagram illustrating an exemplary embodiment of a pixel circuit according to the invention. FIG. 2 is a diagram for describing that a write scan signal and an erase scan signal are received by the pixel circuit of FIG. 1.

Referring to FIGS. 1 and 2, an exemplary embodiment of the pixel circuit 100 may include an organic light emitting diode OLED, a first transistor TR1, a storage capacitor C, a second transistor TR2, and a third transistor TR3.

The organic light emitting diode OLED may include an anode connected to an electrode of the first transistor TR1 (i.e., a driving transistor) and a cathode connected to a low power voltage ELVSS. When the first transistor TR1 is turned on, the organic light emitting diode OLED may emit light based on a current flowing through the first transistor TR1. In such an embodiment, when the first transistor TR1 is turned off, the organic light emitting diode OLED may not emit light because the current may not flow through the first transistor TR1. The first transistor TR1 may include a gate electrode, a first electrode connected to a high power voltage ELVDD, and a second electrode connected to the anode of the organic light emitting diode OLED. As illustrated in FIG. 1, the organic light emitting diode OLED and the first transistor TR1 may be connected in series between the high power voltage ELVDD and the low power voltage ELVSS. The gate electrode of the first transistor TR1 may be connected to a second electrode of the storage capacitor C, a second electrode of the second transistor TR2, and a second electrode of the third transistor TR3. Thus, the gate electrode of the first transistor TR1 may receive a data signal DATA corresponding to an emission sustaining voltage or an emission finishing voltage through the second transistor TR2 and may receive an emission starting voltage through the third transistor TR3. In an exemplary embodiment, as illustrated in FIG. 1, the first transistor TR1 may be a P-type metal-oxide semiconductor ("PMOS") transistor. In such an embodiment, the first transistor TR1 may be turned on when each of the emission starting signal and the data signal applied to the gate electrode of the first transistor TR1 has a low voltage level. In another exemplary embodiment, the first transistor TR1 may be an N-type metal-oxide semiconductor ("NMOS") transistor. In such an embodiment, the first transistor TR1 may be turned on when each of the emission starting signal and the data signal applied to the gate electrode of the first transistor TR1 has a high voltage level. The storage capacitor C may include a first electrode connected to the high power voltage ELVDD and the second electrode connected to the gate electrode of the first transistor TR1. In such an embodiment, the storage capacitor C turns on the first transistor TR1 by storing the emission starting voltage during a desired emission time of the organic light emitting diode OLED, such that the first transistor TR1 may operate in a saturation region as in an analog driving technique.

The second transistor TR2 may include a first electrode that receives the data signal DATA corresponding to the emission sustaining voltage or the emission finishing voltage, the second electrode connected to the gate electrode of the first transistor TR1, and a gate electrode that receives an erase scan signal SER. In an exemplary embodiment, as illustrated in FIG. 1, the second transistor TR2 may be a PMOS transistor. In such an embodiment, the second transistor TR2 may be turned on when the erase scan signal SER applied to the gate electrode of the second transistor TR2 has a low voltage level. In another exemplary embodiment, the second transistor TR2 may be an NMOS transistor. In such an embodiment, the second transistor TR2 may be turned on when the erase scan signal SER applied to the gate electrode of the second transistor TR2 has a high voltage level. When the second transistor TR2 is turned on in response to the erase scan signal SER, the data signal DATA may be applied to the gate electrode of the first transistor TR1. In such embodiments, when the data signal DATA is the emission sustaining voltage, the organic light emitting diode OLED may emit light because the first transistor TR1 is turned on. In such embodiments, when the data signal DATA is the emission finishing voltage, the organic light emitting diode OLED may not emit light because the first transistor TR1 is turned off. In an exemplary embodiment, where the first transistor TR1 is a PMOS transistor, the emission sustaining voltage may have a low voltage level, and the emission finishing voltage may have a high voltage level. In another exemplary embodiment, where the first transistor TR1 is an NMOS transistor, the emission sustaining voltage may have a high voltage level, and the emission finishing voltage may have a low voltage level.

The third transistor TR3 may include a first electrode connected to the emission starting voltage, the second electrode connected to the gate electrode of the first transistor TR1, and a gate electrode that receives a write scan signal SWR. In an exemplary embodiment, as illustrated in FIG. 1, the third transistor TR3 may be a PMOS transistor. In such an embodiment, the third transistor TR3 may be turned on when the write scan signal SWR applied to the gate electrode of the third transistor TR3 has a low voltage level. In another exemplary embodiment, the third transistor TR3 may be an NMOS transistor. In such an embodiment, the third transistor TR3 may be turned on when the write scan signal SWR applied to the gate electrode of the third transistor TR3 has a high voltage level. When the third transistor TR3 is turned on in response to the write scan signal SWR, the emission starting voltage may be applied to the gate electrode of the first transistor TR1. In an exemplary embodiment, as illustrated in FIG. 1, the emission starting voltage may be the low power voltage ELVSS when the first transistor TR1 is a PMOS transistor. In another exemplary embodiment, the emission starting voltage may be a specific voltage having a low voltage level when the first transistor TR1 is a PMOS transistor. Hereinafter, for convenience of description, an exemplary embodiment, where the first through third transistors TR1, TR2 and TR3 are PMOS transistors, each of the emission starting voltage and the emission sustaining voltage has a low voltage level, and the emission finishing voltage has a high voltage level, will be described in detail. However, in an alternative exemplary embodiment, the first through third transistors TR1, TR2 and TR3 may be NMOS transistors or combination of PMOS transistors and NMOS transistors, and a structure of the pixel circuit 100 may be changed according to types of first through third transistors TR1, TR2 and TR3.

In an exemplary embodiment, as illustrated in FIG. 2, the display panel 10 may include a plurality of pixel circuits 100 arranged substantially in a matrix form. The pixel circuits 100 may be connected to a write scan driver, which generates the write scan signal SWR, through write scan signal-lines SWL(1) through SWL(n), where n is an integer greater than or equal to 2. The pixel circuits 100 may be connected to an erase scan driver, which generates the erase scan signal SER, through erase scan signal-lines SEL(1) through SEL(n). In such an embodiment, each of the write scan signal-lines SWL(1) through SWL(n) may be connected to a corresponding pixel-row of the display panel 10. Thus, the write scan signal SWR may be provided to the display panel 10 by a unit of pixel-row or on a pixel row by pixel row basis. In such an embodiment, each of the erase scan signal-lines SEL(1) through SEL(n) may be connected to a corresponding pixel-row of the display panel 10. Thus, the erase scan signal SER may be provided to the display panel 10 by a unit of pixel-row or on a pixel row by pixel row basis. Therefore, the pixel circuits 100 included in a same pixel-row may concurrently receive the write scan signal SWR and may concurrently receive the erase scan signal SER. In such an embodiment, when the emission starting voltage is applied through the third transistor TR3 (i.e., when the third transistor TR3 is turned on in response to the write scan signal SWR), the first transistor TR1 is turned on so that the organic light emitting diode OLED may start emitting light. In such an embodiment, when the data signal DATA corresponding to the emission sustaining voltage is applied through the second transistor TR2 (i.e., when the second transistor TR2 is turned on in response to the erase scan signal SER), the first transistor TR1 is turned on so that the organic light emitting diode OLED may continue to emit light. In such an embodiment, when the data signal DATA corresponding to the emission finishing voltage is applied through the second transistor TR2 (i.e., when the second transistor TR2 is turned on in response to the erase scan signal SER), the first transistor TR1 is turned off so that the organic light emitting diode OLED may finish emitting light. The erase scan signal SER may be applied one or more times during the desired emission time of the organic light emitting diode OLED. Here, the emission of the organic light emitting diode OLED may be sustained or finished according to whether the data signal DATA is the emission sustaining voltage or the emission finishing voltage at a moment when the erase scan signal SER is applied. Such operations will be described in detail with reference to FIGS. 3 and 4.

In an exemplary embodiment, as described above, when each frame starts, the pixel circuit 100 may start the emission of the organic light emitting diode OLED by turning on the first transistor TR1 (i.e., the driving transistor) based on the write scan signal SWR and may sustain the emission of the organic light emitting diode OLED for the desired emission time of the organic light emitting diode OLED based on the erase scan signal SER and the data signal DATA (e.g., may finish the emission of the organic light emitting diode OLED when the desired emission time of the organic light emitting diode OLED elapses). Thus, the pixel circuit 100 may implement a specific gray-scale by adjusting the emission time of the organic light emitting diode OLED while controlling the first transistor TR1 to operate in the saturation region (also referred to as an erase-type hybrid driving technique that mixes a digital driving technique with an analog driving technique). In such an embodiment, the pixel circuit 100 may implement a specific gray-scale based on the emission time of the organic light emitting diode OLED between a time when the organic light emitting diode OLED starts emitting light and a time when the organic light emitting diode OLED finishes emitting light. In exemplary embodiments, the desired emission time of the organic light emitting diode OLED may be determined to be a sum of sub-emission times, in which the emission of the organic light emitting diode OLED is sustained by the data signal DATA having the emission sustaining voltage at a moment when the erase scan signal SER is applied. In one exemplary embodiment, for example, the desired emission time of the organic light emitting diode OLED may be determined to be a sum of consecutive sub-emission times that are set based on a binary coding, a Fibonacci sequence, etc. In such an embodiment, some gray-scales that may not be implemented by the desired emission time of the organic light emitting diode OLED may be implemented based on a dithering technique and the like. In some exemplary embodiments, a gravity centered coding ("GCC") may be used to eliminate a dynamic false contour when the sub-emission times are set. In some exemplary embodiments, the pixel circuit 100 may further include an emission control transistor that is connected to the first transistor TR1 in series.

Figure 3:
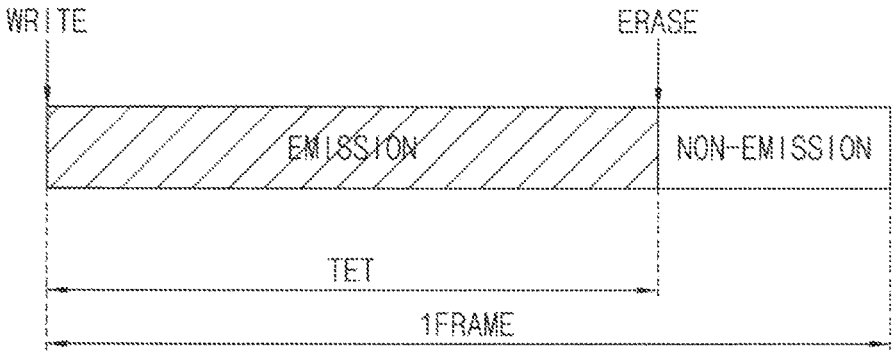
FIG. 3 is a diagram illustrating an emission operation performed by the pixel circuit of FIG. 1.
Figure 4:
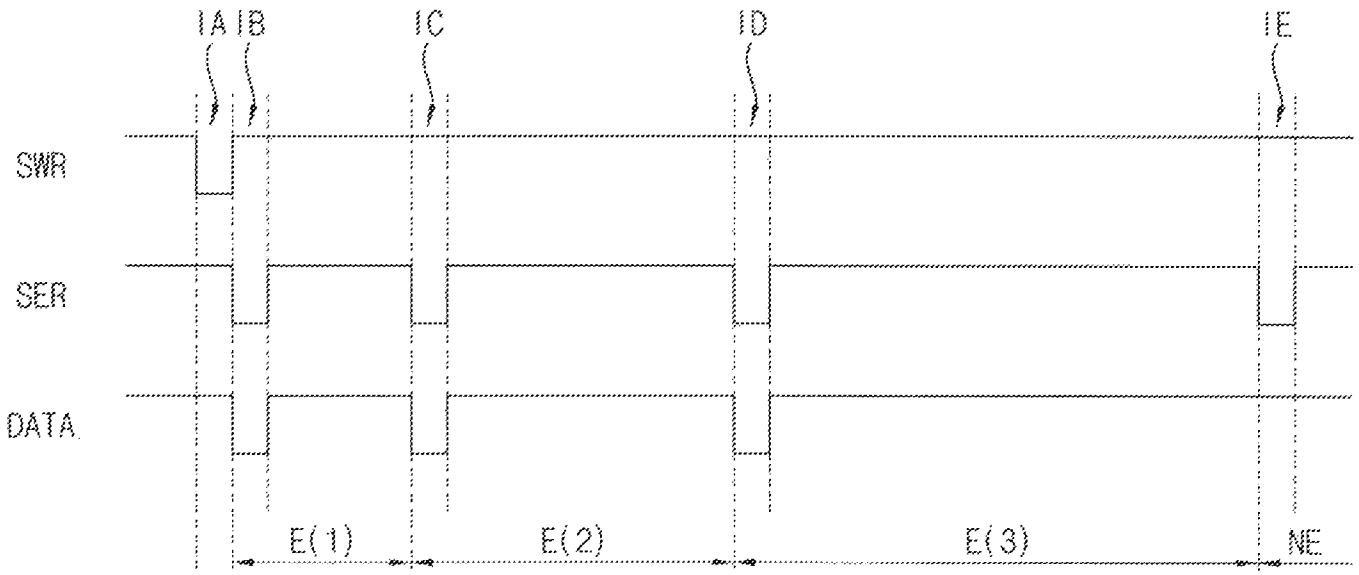
FIG. 4 is a timing diagram for describing an emission operation performed by the pixel circuit of FIG. 1.

FIG. 3 is a diagram illustrating an emission operation performed by the pixel circuit of FIG. 1. FIG. 4 is a timing diagram for describing an emission operation performed by the pixel circuit of FIG. 1.

Referring to FIGS. 3 and 4, when each frame 1FRAME starts, the pixel circuit 100 may start the emission of the organic light emitting diode OLED (indicated by WRITE) by turning on the first transistor TR1 based on the write scan signal SWR and may sustain the emission of the organic light emitting diode OLED for the desired emission time TET of the organic light emitting diode OLED based on the erase scan signal SER and the data signal DATA (indicated by ERASE). Thus, the pixel circuit 100 may implement a specific gray-scale by adjusting the emission time of the organic light emitting diode OLED while controlling the first transistor TR1 to operate in the saturation region. In such an embodiment, as illustrated in FIG. 3, the emission of the organic light emitting diode OLED may be finished (indicated by ERASE) when the desired emission time TET of the organic light emitting diode OLED elapses after the emission of the organic light emitting diode OLED is started (indicated by WRITE).

In such an embodiment, as shown in FIG. 4, when each frame 1FRAME starts, the write scan signal SWR having a low voltage level may be applied to the third transistor TR3 (indicated by IA). Thus, the emission starting voltage corresponding to the low power voltage ELVSS may be applied to the gate electrode of the first transistor TR1 as the third transistor TR3 may be turned on. As a result, the first transistor TR1 may be turned on, and thus the organic light emitting diode OLED may start emitting light. Subsequently, a voltage level of the write scan signal SWR may be changed from a low voltage level to a high voltage level. Thus, the erase scan signal SER having a low voltage level may be applied to the second transistor TR2 (indicated by IB). As a result, the second transistor TR2 may be turned on, and thus the data signal DATA may be applied to the gate electrode of the first transistor TR1. In such an embodiment, the data signal DATA is the emission sustaining voltage having a low voltage level, such that the organic light emitting diode OLED may continue to emit light (i.e., indicated by E(1)). In such an embodiment, although the second transistor TR2 is turned off as a voltage level of the erase scan signal SER is changed from a low voltage level to a high voltage level, the first transistor TR1 may be continuously turned on by the storage capacitor C. Next, when the erase scan signal SER having a low voltage level is applied to the second transistor TR2 again (indicated by IC) after a predetermined time duration, the second transistor TR2 may be turned on, and thus the data signal DATA may be applied to the gate electrode of the first transistor TR1. Here, since the data signal DATA is still the emission sustaining voltage having a low voltage level, the organic light emitting diode OLED may continue to emit light (indicated by E(2)). In such an embodiment, although the second transistor TR2 is turned off as a voltage level of the erase scan signal SER is changed from a low voltage level to a high voltage level, the first transistor TR1 may be continuously turned on by the storage capacitor C.

Subsequently, when the erase scan signal SER having a low voltage level is applied to the second transistor TR2 again (indicated by ID) after a predetermined time duration, the second transistor TR2 may be turned on, and thus the data signal DATA may be applied to the gate electrode of the first transistor TR1. Here, since the data signal DATA is still the emission sustaining voltage having a low voltage level, the organic light emitting diode OLED may continue to emit light (indicated by E(3)). In addition, although the second transistor TR2 is turned off as a voltage level of the erase scan signal SER is changed from a low voltage level to a high voltage level, the first transistor TR1 may be continuously turned on by the storage capacitor C. Next, when the erase scan signal SER having a low voltage level is applied to the second transistor TR2 again (indicated by IE) after a predetermined time duration, the second transistor TR2 may be turned on, and thus the data signal DATA may be applied to the gate electrode of the first transistor TR1. Here, since the data signal DATA is the emission finishing voltage having a high voltage level, the organic light emitting diode OLED may finish emitting light (indicated by NE). Thus, in such an embodiment, the desired emission time of the organic light emitting diode OLED may be determined to be a sum of the sub-emission times (E(1), E(2), and E(3) in FIG. 4) in which the emission of the organic light emitting diode OLED is sustained by the data signal DATA having the emission sustaining voltage at a moment when the erase scan signal SER is applied. In such an embodiment, to implement a specific gray-scale, the pixel circuit 100 may start the emission of the organic light emitting diode OLED by controlling the third transistor TR3 when each frame 1FRAME starts, may sustain the emission of the organic light emitting diode OLED by controlling the second transistor TR2, and may finish the emission of the organic light emitting diode OLED when the desired emission time of the organic light emitting diode OLED elapses. In such an embodiment, some gray-scales that may not be implemented by the desired emission time of the organic light emitting diode OLED may be implemented based on a dithering technique and the like. In some exemplary embodiments, a binary coding, a Fibonacci sequence or a gravity centered coding, for example, may be used when the sub-emission times are set. In some exemplary embodiments, the sub-emission times of each frame may be fixed or changed based on gray-scales to be implemented.

Figure 5:
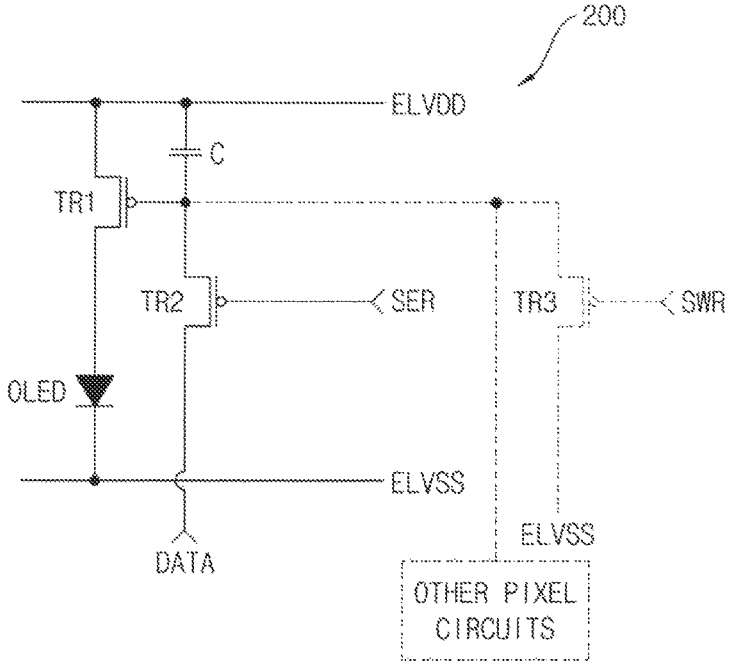
FIG. 5 is a circuit diagram illustrating an alternative exemplary embodiment of a pixel circuit according to the invention.
Figure 6:
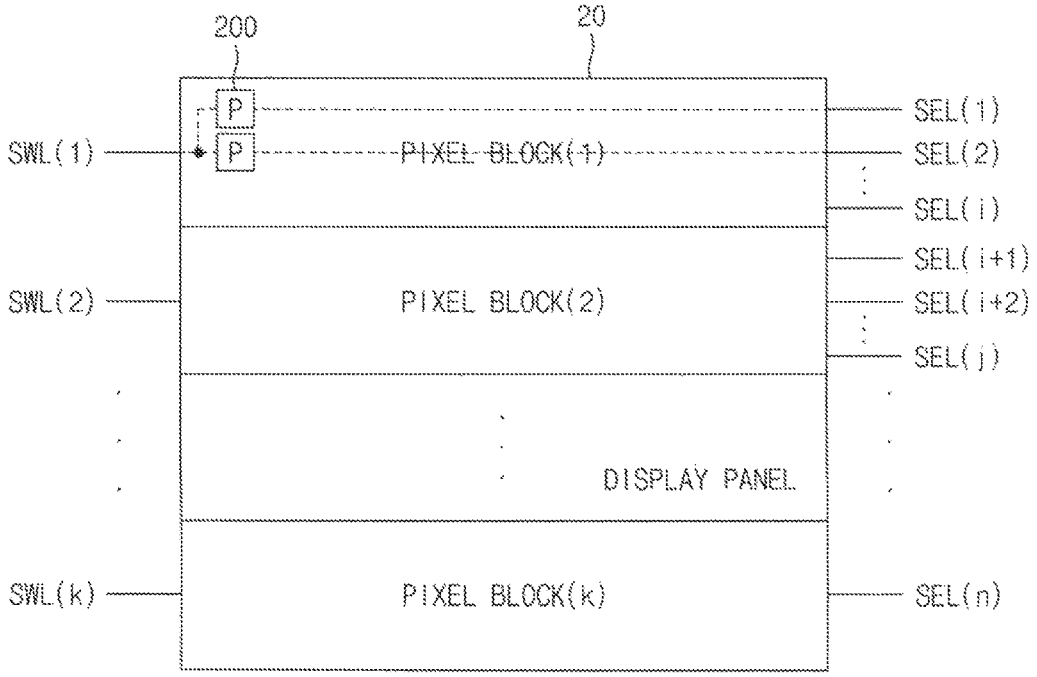
FIG. 6 is a diagram for describing that a write scan signal and an erase scan signal are received by the pixel circuit of FIG. 5.

FIG. 5 is a circuit diagram illustrating an alternative exemplary embodiment of a pixel circuit according to the invention. FIG. 6 is a diagram for describing that a write scan signal and an erase scan signal are received by the pixel circuit of FIG. 5.

Referring to FIGS. 5 and 6, in an alternative exemplary embodiment, the pixel circuit 200 may include an organic light emitting diode OLED, a first transistor TR1, a storage capacitor C, and a second transistor TR2.

The organic light emitting diode OLED may include an anode connected to a second electrode of the first transistor TR1 (i.e., a driving transistor) and a cathode connected to a low power voltage ELVSS. When the first transistor TR1 is turned on, the organic light emitting diode OLED may emit light based on a current flowing through the first transistor TR1. In such an embodiment, when the first transistor TR1 is turned off, the organic light emitting diode OLED may not emit light because the current cannot flow through the first transistor TR1. The first transistor TR1 may include a gate electrode, a first electrode connected to a high power voltage ELVDD, and the second electrode connected to the anode of the organic light emitting diode OLED. The organic light emitting diode OLED and the first transistor TR1 may be connected in series between the high power voltage ELVDD and the low power voltage ELVSS. The gate electrode of the first transistor TR1 may be connected to a second electrode of the storage capacitor C and a second electrode of the second transistor TR2. In such an embodiment, the first transistor TR1 may be connected to an external component for receiving an emission starting voltage (indicated by the third transistor TR3 in FIG. 5). In such an embodiment, the first transistor TR1 of other pixel circuits in a same pixel block may be connected to a same external component, as shown in FIG. 5. Thus, the gate electrode of the first transistor TR1 may receive a data signal DATA corresponding to an emission sustaining voltage or an emission finishing voltage through the second transistor TR2 and may receive the emission starting voltage from the external component. In an exemplary embodiment, as illustrated in FIG. 5, the first transistor TR1 may be a PMOS transistor. In such an embodiment, the first transistor TR1 may be turned on when each of the emission starting signal and the data signal applied to the gate electrode of the first transistor TR1 has a low voltage level. In another exemplary embodiment, the first transistor TR1 may be an NMOS transistor. In such an embodiment, the first transistor TR1 may be turned on when each of the emission starting signal and the data signal applied to the gate electrode of the first transistor TR1 has a high voltage level. The storage capacitor C may include a first electrode connected to the high power voltage ELVDD and the second electrode connected to the gate electrode of the first transistor TR1. Since the storage capacitor C turns on the first transistor TR1 by storing the emission starting voltage during a desired emission time of the organic light emitting diode OLED, the first transistor TR1 may operate in a saturation region like an analog driving technique.

The second transistor TR2 may include a first electrode that receives the data signal DATA corresponding to the emission sustaining voltage or the emission finishing voltage, the second electrode connected to the gate electrode of the first transistor TR1, and a gate electrode that receives an erase scan signal SER. In an exemplary embodiment, as illustrated in FIG. 5, the second transistor TR2 may be a PMOS transistor. In such an embodiment, the second transistor TR2 may be turned on when the erase scan signal SER applied to the gate electrode of the second transistor TR2 has a low voltage level. In another exemplary embodiment, the second transistor TR2 may be an NMOS transistor. In such an embodiment, the second transistor TR2 may be turned on when the erase scan signal SER applied to the gate electrode of the second transistor TR2 has a high voltage level. When the second transistor TR2 is turned on in response to the erase scan signal SER, the data signal DATA may be applied to the gate electrode of the first transistor TR1. Here, when the data signal DATA is the emission sustaining voltage, the organic light emitting diode OLED may emit light because the first transistor TR1 is turned on. In such an embodiment, when the data signal DATA is the emission finishing voltage, the organic light emitting diode OLED may not emit light because the first transistor TR1 is turned off. In an exemplary embodiment, when the first transistor TR1 is a PMOS transistor, the emission sustaining voltage may have a low voltage level, and the emission finishing voltage may have a high voltage level. In another exemplary embodiment, when the first transistor TR1 is an NMOS transistor, the emission sustaining voltage may have a high voltage level, and the emission finishing voltage may have a low voltage level. In exemplary embodiments, the pixel circuit 200 may receive the emission starting signal from the external component. In an exemplary embodiment, as illustrated in FIG. 5, the emission starting voltage may be the low power voltage ELVSS when the first transistor TR1 is a PMOS transistor. In another exemplary embodiment, the emission starting voltage may be a specific voltage having a low voltage level when the first transistor TR1 is a PMOS transistor. For convenience of description, an exemplary embodiment, where that the first and second transistors TR1 and TR2 are PMOS transistors, each of the emission starting voltage and the emission sustaining voltage has a low voltage level, and the emission finishing voltage has a high voltage level, will be described in detail. However, in another alternative exemplary embodiment, the first and second transistors TR1 and TR2 may be NMOS transistors or combination of PMOS transistors and NMOS transistors, and thus a structure of the pixel circuit 200 may be changed according to types of first and second transistors TR1 and TR2.

In an exemplary embodiment, as illustrated in FIG. 6, the display panel 20 may include a plurality of pixel circuits 200 arranged substantially in a matrix form. In the display panel 20, the pixel circuits 200 may define or constitute pixel-blocks PIXEL BLOCK(1) through PIXEL BLOCK(k), where k is an integer greater than or equal to 2. The pixel circuits 200 may be connected to a write scan driver, which generates the write scan signal SWR, through write scan signal-lines SWL(1) through SWL(k). The pixel circuits 200 may be connected to an erase scan driver, which generates the erase scan signal SER, through erase scan signal-lines SEL(1) through SEL(n), where n is an integer greater than or equal to 2. In such an embodiment, each of the write scan signal-lines SWL(1) through SWL(k) may be connected to a corresponding of the pixel-blocks PIXEL BLOCK(1) through PIXEL BLOCK(k), each having a plurality of pixel-rows of the display panel 20. Thus, the write scan signal SWR may be provided to the display panel 20 by a unit of pixel-block. In such an embodiment, each of the erase scan signal-lines SEL(1) through SEL(n) may be connected to a corresponding pixel-row of the display panel 20. Thus, the erase scan signal SER may be provided to the display panel 20 by a unit of pixel-row. Therefore, the pixel circuits 200 included in one of the pixel-blocks PIXEL BLOCK(1) through PIXEL BLOCK(k) may concurrently receive the write scan signal SWR, and the pixel circuits 200 included in pixel-rows corresponding to the one of the pixel-blocks PIXEL BLOCK(1) through PIXEL BLOCK(k) may concurrently receive the erase scan signal SER. Hence, when the emission starting voltage is applied from the external component, the first transistor TR1 is turned on so that the organic light emitting diode OLED may start emitting light. Subsequently, when the data signal DATA corresponding to the emission sustaining voltage is applied through the second transistor TR2 (e.g., when the second transistor TR2 is turned on in response to the erase scan signal SER), the first transistor TR1 is turned on so that the organic light emitting diode OLED may continue to emit light. Next, when the data signal DATA corresponding to the emission finishing voltage is applied through the second transistor TR2 (e.g., when the second transistor TR2 is turned on in response to the erase scan signal SER), the first transistor TR1 is turned off so that the organic light emitting diode OLED may finish emitting light. The erase scan signal SER may be applied one or more times during the desired emission time of the organic light emitting diode OLED. Here, the emission of the organic light emitting diode OLED may be sustained or finished according to whether the data signal DATA has the emission sustaining voltage or the emission finishing voltage at a moment when the erase scan signal SER is applied.

In such an embodiment, as described above, when each frame starts, the pixel circuit 200 may start the emission of the organic light emitting diode OLED by turning on the first transistor TR1 (i.e., the driving transistor) based on the write scan signal SWR and may sustain the emission of the organic light emitting diode OLED for the desired emission time of the organic light emitting diode OLED based on the erase scan signal SER and the data signal DATA (e.g., may finish the emission of the organic light emitting diode OLED when the desired emission time of the organic light emitting diode OLED elapses). Thus, the pixel circuit 200 may implement a specific gray-scale by adjusting the emission time of the organic light emitting diode OLED while controlling the first transistor TR1 to operate in the saturation region. In such an embodiment, the pixel circuit 200 may implement a specific gray-scale based on the emission time of the organic light emitting diode OLED between a time when the organic light emitting diode OLED starts emitting light and a time when the organic light emitting diode OLED finishes emitting light. In exemplary embodiments, the desired emission time of the organic light emitting diode OLED may be determined to be a sum of sub-emission times in which the emission of the organic light emitting diode OLED is sustained by the data signal DATA having the emission sustaining voltage at a moment when the erase scan signal SER is applied. In one exemplary embodiment, for example, the desired emission time of the organic light emitting diode OLED may be determined to be a sum of consecutive sub-emission times that are set based on a binary coding, a Fibonacci sequence, etc. In such an embodiment, some gray-scales that cannot be implemented by the desired emission time of the organic light emitting diode OLED may be implemented based on a dithering technique and the like. In some exemplary embodiments, a gravity centered coding may be used to eliminate a dynamic false contour when the sub-emission times are set. In some exemplary embodiments, the pixel circuit 200 may further include an emission control transistor that is connected to the first transistor TR1 in series.

Figure 7:
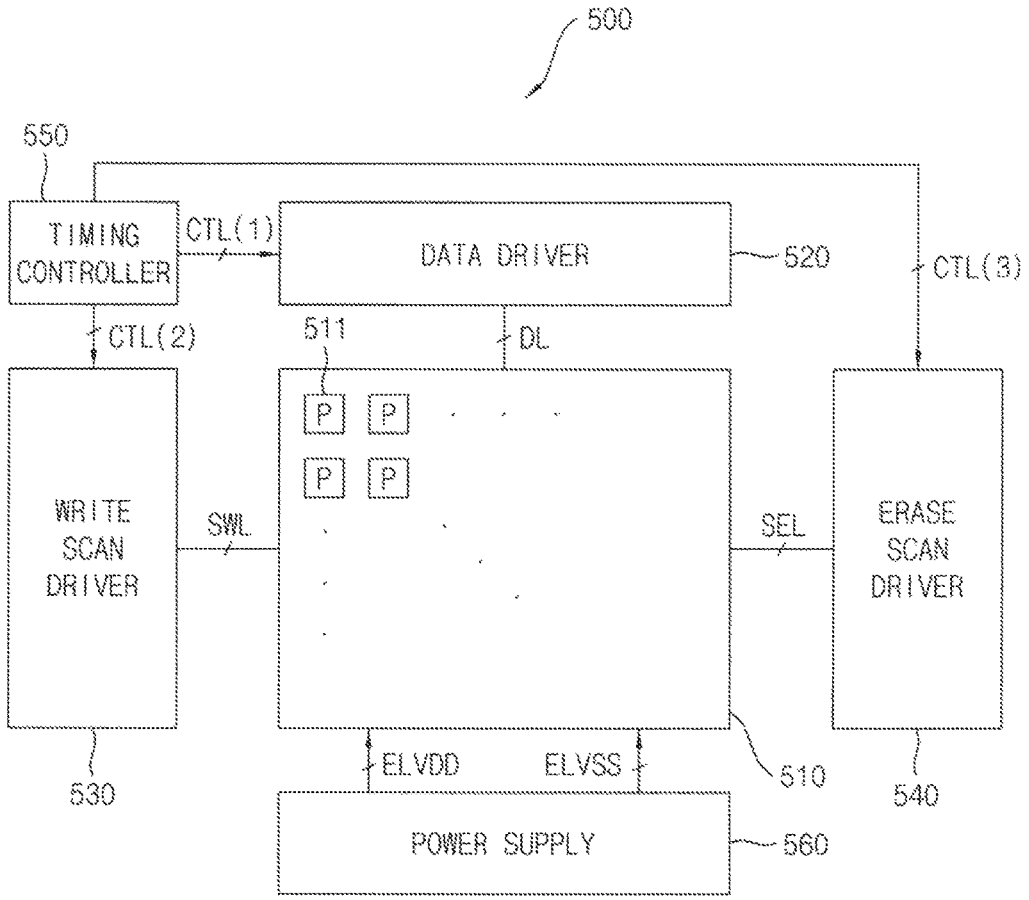
FIG. 7 is a block diagram illustrating an exemplary embodiment of an organic light emitting display device according to the invention.
Figure 8:
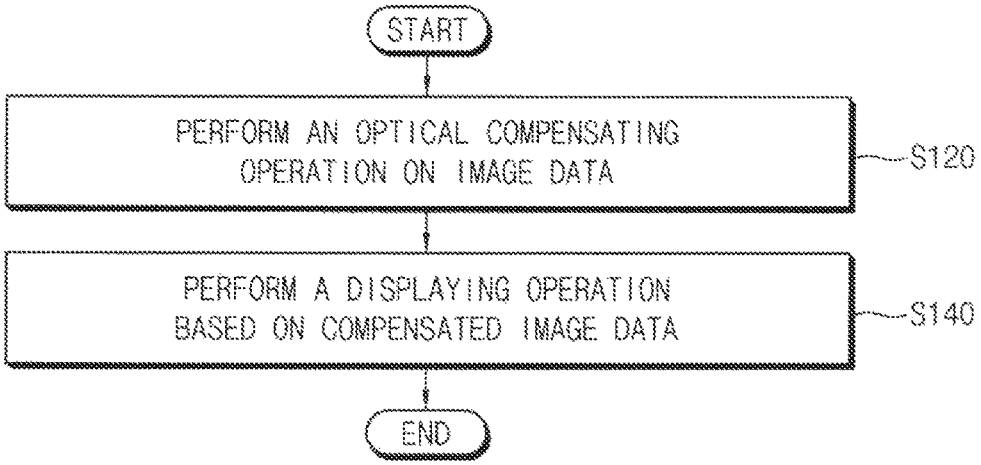
FIG. 8 is a flowchart illustrating an exemplary in which the organic light emitting display device of FIG. 7 operates.

FIG. 7 is a block diagram illustrating an exemplary embodiment of an organic light emitting display device according to the invention. FIG. 8 is a flowchart illustrating an exemplary in which the organic light emitting display device of FIG. 7 operates.

Referring to FIGS. 7 and 8, an exemplary embodiment of the organic light emitting display device 500 may include a display panel 510, a data driver 520, a write scan driver 530, an erase scan driver 540, a timing controller 550, and a power supply 560.

The display panel 510 may include a plurality of pixel circuits 511. The display panel 510 may be connected to the write scan driver 530 through write scan signal-lines SWL, may be connected to the erase scan driver 540 through erase scan signal-lines SEL, and may be connected to the data driver 520 through data-lines DL. In such an embodiment, the pixel circuits 511 may be arranged substantially in a matrix form in the display panel 510. The data driver 520 may provide a data signal to the display panel 510 through the data-lines DL. The write scan driver 530 may provide a write scan signal to the display panel 510 through the write scan signal-lines SWL. The erase scan driver 540 may provide an erase scan signal to the display panel 510 through the erase scan signal-lines SEL. In an exemplary embodiment, the write scan driver 530 and the erase scan driver 540 may be implemented by decoder-type scan circuits, such that the write scan driver 530 and the erase scan driver 540 may non-sequentially (e.g., randomly) provide the write scan signal and the erase scan signal to the display panel 510. Thus, the write scan driver 530 and the erase scan driver 540 may easily (e.g., freely) adjust emission times of the pixel circuits 511 by concurrently controlling the pixel circuits 511 to emit light or not to emit light. The timing controller 550 may control the data driver 520, the write scan driver 530, and the erase scan driver 540. To control the data driver 520, the write scan driver 530, and the erase scan driver 540, the timing controller 550 may generate control signals CTL(1), CTL(2), and CTL(3) to provide the control signals CTL(1), CTL(2), and CTL(3) to the data driver 520, the write scan driver 530, and the erase scan driver 540, respectively. The power supply 560 may provide a high power voltage ELVDD and a low power voltage ELVSS to the display panel 510. In exemplary embodiments, the pixel circuit 511 driven by an erase-type hybrid driving technique that mixes a digital driving technique with an analog driving technique may not include an internal compensation circuit for compensating threshold voltage deviation of a driving transistor. Thus, the timing controller 550 may receive image data from an external source, may perform an optical compensating operation on the image data to generate compensated image data, and may provide the compensated image data to the data driver 520. Thus, the data driver 520 may convert the compensated image data into the data signal to provide the data signal to the display panel 510. In such an embodiment, the organic light emitting display device 500 may use an optical compensating technique to compensate the threshold voltage deviation of the driving transistor included in the pixel circuit 511. In such an embodiment, as illustrated in FIG. 8, the organic light emitting display device 500 may perform an optical compensating operation on the image data input from the external source (S120) and then may perform a displaying operation based on the compensated image data (S140).

The pixel circuit 511 may be driven by the erase-type hybrid driving technique that mixes the digital driving technique with the analog driving technique. Thus, each of the pixel circuits 511 may start an emission of the organic light emitting diode based on the write scan signal and may sustain the emission of the organic light emitting diode for a desired emission time of the organic light emitting diode based on the erase scan signal and the data signal. In an exemplary embodiment, the write scan driver 530 may provide the write scan signal to the display panel 510 by a unit of pixel-row of the display panel 510, and the erase scan driver 540 may provide the erase scan signal to the display panel 510 by a unit of pixel-row of the display panel 510. In such an embodiment, each of the pixel circuits 511 may include an organic light emitting diode having an anode and a cathode that is connected to the low power voltage ELVSS, a first transistor (e.g., a driving transistor) having a gate electrode, a first electrode that is connected to the high power voltage ELVDD, and a second electrode that is connected to the anode of the organic light emitting diode, a storage capacitor connected between the high power voltage ELVDD and the gate electrode of the first transistor, a second transistor having a first electrode that receives the data signal corresponding to the emission sustaining voltage or the emission finishing voltage, a second electrode that is connected to the gate electrode of the first transistor, and a gate electrode that receives the erase scan signal, and a third transistor having a first electrode that is connected to the emission starting voltage corresponding to the low power voltage ELVSS, a second electrode that is connected to the gate electrode of the first transistor, and a gate electrode that receives the write scan signal. In such an embodiment, each of the pixel circuits 511 may start an emission of the organic light emitting diode when the first transistor is turned on as the emission starting voltage is applied to the gate electrode of the first transistor through the third transistor, may sustain the emission of the organic light emitting diode when the first transistor is turned on as the emission sustaining voltage is applied to the gate electrode of the first transistor through the second transistor, and may finish the emission of the organic light emitting diode when the first transistor is turned off as the emission finishing voltage is applied to the gate electrode of the first transistor through the second transistor. The emission starting voltage may be applied to the gate electrode of the first transistor when each frame starts. The emission finishing voltage may be applied to the gate electrode of the first transistor when the desired emission time of the organic light emitting diode elapses after the emission starting voltage is applied to the gate electrode of the first transistor. The emission sustaining voltage may be applied to the gate electrode of the first transistor before the desired emission time of the organic light emitting diode elapses after the emission starting voltage is applied to the gate electrode of the first transistor.

In another exemplary embodiment, the write scan driver 530 may provide the write scan signal to the display panel 510 by a unit of pixel-block of the display panel 510, where one pixel-block includes a plurality of pixel-rows, and the erase scan driver 540 may provide the erase scan signal to the display panel 510 by a unit of pixel-row of the display panel 510. In such an embodiment, each of the pixel circuits 511 may include an organic light emitting diode having an anode and a cathode that is connected to the low power voltage ELVSS, a first transistor (e.g., a driving transistor) having a gate electrode, a first electrode that is connected to the high power voltage ELVDD, and a second electrode that is connected to the anode of the organic light emitting diode, a storage capacitor connected between the high power voltage ELVDD and the gate electrode of the first transistor, and a second transistor having a first electrode that receives the data signal corresponding to the emission sustaining voltage or the emission finishing voltage, a second electrode that is connected to the gate electrode of the first transistor, and a gate electrode that receives the erase scan signal. Here, each of the pixel circuits 511 may start an emission of the organic light emitting diode when the first transistor is turned on as the emission starting voltage is applied to the gate electrode of the first transistor, may sustain the emission of the organic light emitting diode when the first transistor is turned on as the emission sustaining voltage is applied to the gate electrode of the first transistor through the second transistor, and may finish the emission of the organic light emitting diode when the first transistor is turned off as the emission finishing voltage is applied to the gate electrode of the first transistor through the second transistor. The emission starting voltage may be applied to the gate electrode of the first transistor when each frame starts. The emission finishing voltage may be applied to the gate electrode of the first transistor when the desired emission time of the organic light emitting diode elapses after the emission starting voltage is applied to the gate electrode of the first transistor. The emission sustaining voltage may be applied to the gate electrode of the first transistor before the desired emission time of the organic light emitting diode elapses after the emission starting voltage is applied to the gate electrode of the first transistor. In such an embodiment, as described above, the pixel circuit 511 included in the organic light emitting display device 500 may start the emission of the organic light emitting diode by turning on the driving transistor based on the write scan signal when each frame starts and may sustain the emission of the organic light emitting diode for the desired emission time of the organic light emitting diode based on the erase scan signal and the data signal (e.g., may finish the emission of the organic light emitting diode when the desired emission time of the organic light emitting diode elapses). Thus, the pixel circuit 511 may implement a specific gray-scale by adjusting an emission time of the organic light emitting diode while controlling the driving transistor to operate in a saturation region. As a result, the organic light emitting display device 500 may display a high-quality image. In some exemplary embodiments, the data driver 520, the write scan driver 530, the erase scan driver 540, the timing controller 550, and the power supply 560 may be implemented by a single integrated circuit ("IC"). In some exemplary embodiments, some of the data driver 520, the write scan driver 530, the erase scan driver 540, the timing controller 550, and the power supply 560 may be implemented by a single IC.

Figure 9:
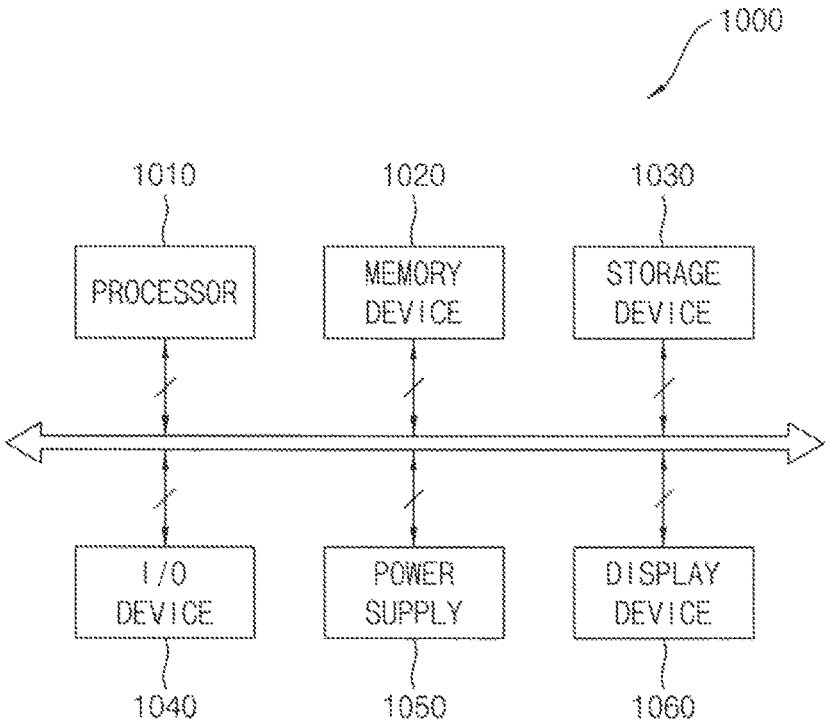
FIG. 9 is a block diagram illustrating an exemplary embodiment an electronic device according to the invention.
Figure 10A:
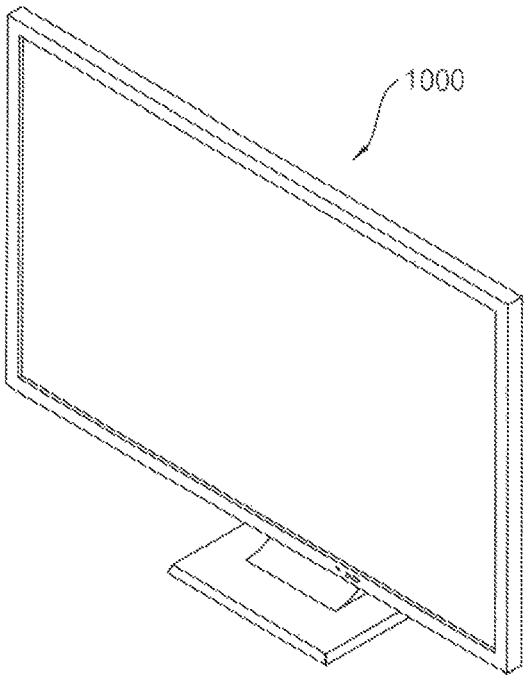
FIG. 10A is a diagram illustrating an exemplary embodiment in which the electronic device of FIG. 9 is implemented as a television.
Figure 10B:
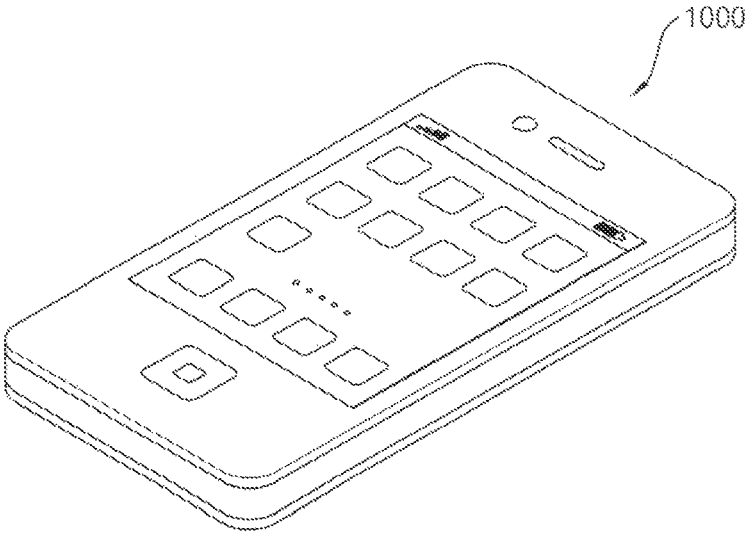
FIG. 10B is a diagram illustrating an exemplary embodiment in which the electronic device of FIG. 9 is implemented as a smart-phone.

FIG. 9 is a block diagram illustrating an exemplary embodiment of an electronic device according to the invention. FIG. 10A is a diagram illustrating an exemplary embodiment in which the electronic device of FIG. 9 is implemented as a television. FIG. 10B is a diagram illustrating an exemplary embodiment in which the electronic device of FIG. 9 is implemented as a smart-phone.

Referring to FIGS. 9 to 10B, an exemplary embodiment of the electronic device 1000 may include a processor 1010, a memory device 1020, a storage device 1030, an input/output ("I/O") device 1040, a power supply 1050, and an organic light emitting display device 1060. In an exemplary embodiment, the organic light emitting display device 1060 may be the organic light emitting display device 500 of FIG. 7. In an exemplary embodiment, the electronic device 1000 may further include a plurality of ports for communicating with a video card, a sound card, a memory card, a universal serial bus ("USB") device, other electronic devices, etc. In an exemplary embodiment, as illustrated in FIG. 10A, the electronic device 1000 may be implemented as the television. In another exemplary embodiment, as illustrated in FIG. 10B, the electronic device 1000 may be implemented as the smart-phone. However, the electronic device 1000 is not limited thereto. In one exemplary embodiment, for example, the electronic device 1000 may be implemented as a cellular phone, a video phone, a smart pad, a smart watch, a tablet personal computer ("PC"), a car navigation system, a computer monitor, a laptop, a head mounted display ("HMD"), etc.

The processor 1010 may perform various computing functions. The processor 1010 may be a microprocessor, a central processing unit ("CPU"), an application processor ("AP"), etc. The processor 1010 may be coupled to other components via an address bus, a control bus, a data bus, etc. Further, the processor 1010 may be coupled to an extended bus such as a peripheral component interconnection ("PCI") bus. The memory device 1020 may store data for operations of the electronic device 1000. In one exemplary embodiment, example, the memory device 1020 may include at least one non-volatile memory device such as an erasable programmable read-only memory ("EPROM") device, an electrically erasable programmable read-only memory ("EEPROM") device, a flash memory device, a phase change random access memory ("PRAM") device, a resistance random access memory ("RRAM") device, a nano floating gate memory ("NFGM") device, a polymer random access memory ("PoRAM") device, a magnetic random access memory ("MRAM") device, a ferroelectric random access memory ("FRAM") device, etc, and/or at least one volatile memory device such as a dynamic random access memory ("DRAM") device, a static random access memory ("SRAM") device, a mobile DRAM device, etc. The storage device 1030 may include a solid state drive ("SSD") device, a hard disk drive ("HDD") device, a compact disc read-only memory ("CD-ROM") device, etc. The I/O device 1040 may include an input device such as a keyboard, a keypad, a touchpad, a touch-screen, a mouse device, etc, and an output device such as a printer, a speaker, etc. The power supply 1050 may provide power for operations of the electronic device 1000.

The organic light emitting display device 1060 may communicate with other components via the buses or other communication links. In some exemplary embodiments, the organic light emitting display device 1060 may be included in the I/O device 1040. In an exemplary embodiment, as described above, the organic light emitting display device 1060 may operate based on an erase-type hybrid driving technique that mixes a digital driving technique with an analog driving technique. To operate based on the erase-type hybrid driving technique, the organic light emitting display device 1060 may include a display panel having a plurality of pixel circuits, a data driver that provides a data signal to the display panel, a write scan driver that provides a write scan signal to the display panel, an erase scan driver that provides an erase scan signal to the display panel, a timing controller that controls the data driver, the write scan driver and the erase scan driver, and a power supply that provides a high power voltage and a low power voltage to the display panel. In such an embodiment, each of the pixel circuits may start an emission of the organic light emitting diode based on the write scan signal and may sustain the emission of the organic light emitting diode for a desired emission time of the organic light emitting diode based on the erase scan signal and the data signal. In such an embodiment, each of the pixel circuits may start the emission of the organic light emitting diode by turning on the driving transistor based on the write scan signal when each frame starts and may sustain the emission of the organic light emitting diode for the desired emission time of the organic light emitting diode based on the erase scan signal and the data signal (e.g., may finish the emission of the organic light emitting diode when the desired emission time of the organic light emitting diode elapses). Thus, each of the pixel circuits may implement a specific gray-scale by adjusting an emission time of the organic light emitting diode while controlling the driving transistor to operate in a saturation region.

In an exemplary embodiment, the write scan driver of the organic light emitting display device 1060 may provide the write scan signal to the display panel by a unit of pixel-row of the display panel, and the erase scan driver of the organic light emitting display device 1060 may provide the erase scan signal to the display panel by a unit of pixel-row of the display panel. In such an embodiment, each of the pixel circuits may include an organic light emitting diode having an anode and a cathode that is connected to a low power voltage, a first transistor having a gate electrode, a first electrode that is connected to a high power voltage, and a second electrode that is connected to the anode of the organic light emitting diode, a storage capacitor connected between the high power voltage and the gate electrode of the first transistor, a second transistor having a first electrode that receives the data signal, a second electrode that is connected to the gate electrode of the first transistor, and a gate electrode that receives the erase scan signal, and a third transistor having a first electrode that is connected to the emission starting voltage corresponding to the low power voltage, a second electrode that is connected to the gate electrode of the first transistor, and a gate electrode that receives the write scan signal. In another exemplary embodiment, the write scan driver of the organic light emitting display device 1060 may provide the write scan signal to the display panel by a unit of pixel-block of the display panel, where each pixel-block includes a plurality of pixel-rows, and the erase scan driver of the organic light emitting display device 1060 may provide the erase scan signal to the display panel by a unit of pixel-row of the display panel. In such an embodiment, each of the pixel circuits may include an organic light emitting diode having an anode and a cathode that is connected to a low power voltage, a first transistor having a gate electrode, a first electrode that is connected to a high power voltage, and a second electrode that is connected to the anode of the organic light emitting diode, a storage capacitor connected between the high power voltage and the gate electrode of the first transistor, and a second transistor having a first electrode that receives the data signal, a second electrode that is connected to the gate electrode of the first transistor, and a gate electrode that receives the erase scan signal. In such an embodiment, the organic light emitting display device 1060 is substantially the same as those described above, and any repetitive detailed description thereof will be omitted.

The inventive concept may be applied to an organic light emitting display device and an electronic device including the organic light emitting display device. For example, the inventive concept may be applied to a cellular phone, a smart phone, a video phone, a smart pad, a smart watch, a tablet PC, a car navigation system, a television, a computer monitor, a laptop, a head mounted display, etc.

The foregoing is illustrative of exemplary embodiments and is not to be construed as limiting thereof. Although a few exemplary embodiments have been described, those skilled in the art will readily appreciate that many modifications are possible in the exemplary embodiments without materially departing from the novel teachings and advantages of the inventive concept. Accordingly, all such modifications are intended to be included within the scope of the inventive concept as defined in the claims. Therefore, it is to be understood that the foregoing is illustrative of various exemplary embodiments and is not to be construed as limited to the specific exemplary embodiments disclosed, and that modifications to the disclosed exemplary embodiments, as well as other exemplary embodiments, are intended to be included within the scope of the appended claims.

What is claimed is:

1. A pixel circuit comprising:

an organic light emitting diode comprising an anode, and a cathode connected to a low power voltage;

a first transistor comprising a gate electrode, a first electrode connected to a high power voltage, and a second electrode connected to the anode of the organic light emitting diode;

a storage capacitor connected between the high power voltage and the gate electrode of the first transistor;

a second transistor comprising a first electrode which receives a data signal having an emission sustaining voltage or an emission finishing voltage, a second electrode connected to the gate electrode of the first transistor, and a gate electrode which receives an erase scan signal; and a third transistor comprising a first electrode connected to an emission starting voltage and the cathode of the organic light emitting diode, a second electrode connected to the gate electrode of the first transistor, and a gate electrode which receives a write scan signal, wherein an emission of the organic light emitting diode is started when the first transistor is turned on in response to the emission starting voltage applied to the gate electrode of the first transistor through the third transistor, wherein the emission of the organic light emitting diode is sustained when the first transistor is turned on in response to the emission sustaining voltage applied to the gate electrode of the first transistor through the second transistor, and wherein the emission of the organic light emitting diode is finished when the first transistor is turned off in response to the emission finishing voltage applied to the gate electrode of the first transistor through the second transistor.

2. The pixel circuit of claim 1, wherein the first transistor operates in a saturation region.

3. The pixel circuit of claim 1, wherein each of the first through third transistors is a p-type metal oxide semiconductor transistor, the emission starting voltage has a low voltage level, the emission sustaining voltage has a low voltage level, and the emission finishing voltage has a high voltage level.

4. The pixel circuit of claim 3, wherein the emission starting voltage is the low power voltage.

5. The pixel circuit of claim 1, wherein the emission starting voltage is applied to the gate electrode of the first transistor when each frame starts, the emission finishing voltage is applied to the gate electrode of the first transistor when a predetermined emission time of the organic light emitting diode elapses after the emission starting voltage is applied to the gate electrode of the first transistor, and the emission sustaining voltage is applied to the gate electrode of the first transistor before the predetermined emission time of the organic light emitting diode elapses after the emission starting voltage is applied to the gate electrode of the first transistor.

6. The pixel circuit of claim 5, wherein the predetermined emission time of the organic light emitting diode is determined to be a sum of consecutive sub-emission times which are set based on a binary coding or a Fibonacci sequence.

7. An organic light emitting display device comprising:

a display panel comprising a plurality of pixel circuits;

a data driver which provides a data signal to the display panel;

a write scan driver which provides a write scan signal to the display panel;

an erase scan driver which provides an erase scan signal to the display panel;

a timing controller which controls the data driver, the write scan driver, and the erase scan driver; and a power supply which provides a high power voltage and a low power voltage to the display panel, wherein each of the pixel circuits starts an emission of an organic light emitting diode based on the write scan signal and sustains the emission of the organic light emitting diode for a predetermined emission time of the organic light emitting diode based on the erase scan signal and the data signal, wherein each of the pixel circuits comprises:

the organic light emitting diode comprising an anode, and a cathode connected to the low power voltage;

a first transistor including a gate electrode, a first electrode connected to the high power voltage, and a second electrode connected to the anode of the organic light emitting diode;

a storage capacitor connected between the high power voltage and the gate electrode of the first transistor;

a second transistor comprising a first electrode which receives the data signal corresponding to an emission sustaining voltage or an emission finishing voltage, a second electrode connected to the gate electrode of the first transistor, and a gate electrode which receives the erase scan signal; and a third transistor comprising a first electrode connected to an emission starting voltage corresponding to the low power voltage and the cathode of the organic light emitting diode, a second electrode connected to the gate electrode of the first transistor, and a gate electrode which receives the write scan signal, wherein the emission of the organic light emitting diode is started when the first transistor is turned on in response to the emission starting voltage applied to the gate electrode of the first transistor through the third transistor, wherein the emission of the organic light emitting diode is sustained when the first transistor is turned on in response to the emission sustaining voltage applied to the gate electrode of the first transistor through the second transistor, and wherein the emission of the organic light emitting diode is finished when the first transistor is turned off in response to the emission finishing voltage applied to the gate electrode of the first transistor through the second transistor.

8. The display device of claim 7, wherein the timing controller receives image data from an external source, performs an optical compensating operation on the image data to generate compensated image data, and provides the compensated image data to the data driver.

9. The display device of claim 7, wherein the write scan driver provides the write scan signal to the display panel by a unit of pixel-row of the display panel.

10. The pixel circuit of claim 7, wherein the emission starting voltage is applied to the gate electrode of the first transistor when each frame starts, the emission finishing voltage is applied to the gate electrode of the first transistor when the predetermined emission time of the organic light emitting diode elapses after the emission starting voltage is applied to the gate electrode of the first transistor, and the emission sustaining voltage is applied to the gate electrode of the first transistor before the predetermined emission time of the organic light emitting diode elapses after the emission starting voltage is applied to the gate electrode of the first transistor.

* * * * *